United States Patent [19]

Sakakima et al.

[11] 4,312,683

[45] Jan. 26, 1982

[54] METHOD FOR HEAT-TREATING AMORPHOUS ALLOY FILMS

[75] Inventors: Hiroshi Sakakima, Hirakata; Harufumi Senno, Yamatokoriyama; Yukihiro Yanagiuchi, Katano; Eiichi Hirota, Hirakata, all of Japan

[73] Assignee: Matsushita Electric Industrial Co., Ltd., Osaka, Japan

[21] Appl. No.: 184,323

[22] Filed: Sep. 5, 1980

[30] Foreign Application Priority Data

Sep. 5, 1979 [JP] Japan ..... 54-114643

[51] Int. Cl.[3] ..... C21D 1/04

[52] U.S. Cl. ..... 148/108; 148/31.55

[58] Field of Search ..... 148/100, 101, 103, 108, 148/120, 121, 122, 31.55

[56] References Cited

U.S. PATENT DOCUMENTS

| | | | |
|---|---|---|---|
| 4,033,795 | 7/1977 | Berry et al. | 148/31.55 |
| 4,126,287 | 11/1978 | Mendelsohn et al. | 75/122 |
| 4,152,147 | 5/1979 | Hasegawa | 75/123 C |
| 4,221,592 | 9/1980 | Ray | 75/123 B |

FOREIGN PATENT DOCUMENTS 51-73923 6/1976 Japan .

OTHER PUBLICATIONS

Mitchell et al., "ΔE Effect and Magnetomechanical Coupling $Fe_{80}B_{20}$ and $Fe_{78}Si_{10}B_{12}$ Glassy Ribbons," IEEE Trans. on Mag. vol.: May 14, No. 6, Nov. 1978, pp. 1169–1171.

Hasegawa et al., "Advances in Ferromagnetic Metallic Glasses" AIP Conference Proceedings No. 34, American Inst. of Phys. 1976, pp. 298–303.

Graham et al., "Magnetic Properties of Amorphous Materials", Metals Technology, Jun. 1980, pp. 244–247.

*Primary Examiner*—L. Dewayne Rutledge
*Assistant Examiner*—John P. Sheehan
*Attorney, Agent, or Firm*—Wenderoth, Lind & Ponack

[57] ABSTRACT

Amorphous alloy films are heat-treated in the presence of a magnetic field directed in a particular direction so as to suppress induced magnetic anisotropy in the film. The directed magnetic field includes a vertical magnetic field whose direction is perpendicular to the plane of the film, and a rotating magnetic field whose direction is being rapidly changed within a parallel plane with respect to the plane of the amorphous alloy film.

4 Claims, 16 Drawing Figures

A: heat-treated for 30 min. at 220°C in the presence of a vertical magnetic field (H=5000 Oe)

B: heat-treated for 30 min. at 220°C in the presence of a rotating magnetic field (H=2000 Oe)

C: heat-treated for 30 min. at 220°C in the presence of a parallel magnetic field (H=2000 Oe)

D: without heat treatment

A: heat-treated in the presence of a vertical magnetic field

B: heat-treated in the presence of a rotating magnetic field temperature of heat treatment $T_A$ 1. without heat treatment
3. heat-treated for 30 min. at 220°C in the presence of a vertical magnetic field
2. heat-treated for 15 min. at 220°C in the presence of a rotating magnetic field 1. without heat treatment
2. heat-treated for 3 min. at 410°C in the presence of a vertical magnetic field
3. heat-treated for 5 min. at 410°C in the presence of a rotating magnetic field

METHOD FOR HEAT-TREATING AMORPHOUS ALLOY FILMS

BACKGROUND OF THE INVENTION

This invention relates to a method for heat-treating amorphous alloys, and more particularly, to a method for heat-treating amorphous alloys having high permeability.

Recently, production techniques for obtaining amorphous alloy foils or ribbons, in which certain component materials are quenched from the molten state to the solid state at extremely high rates, have been developed, and considerable academic and industrial efforts are being undertaken not only to develop their useful applications, but also to further investigate their relevant characteristics. Since the amorphous alloy materials obtained through the splat cooling method are generally free from crystalline anisotropy, the consequent materials are assumed to be potentially useful soft magnetic materials. However, the magnetic properties of the amorphous alloy materials which have been subjected to the splat cooling method are not so preferable, and thus, the heat treatment thereof is conventionally indispensable to improve their inherent properties. With respect to the annealing method for the amorphous alloy material, it has already been well known that the heat treatment is executed at a specific temperature ($T_A$), when the crystallization temperature (Tx) of the amorphous alloy material is higher than its Curie temperature (Tc). Namely, according to the conventional annealing methods, such temperature ($T_A$) as described above lies in the range of $Tc<T_A<Tx$. Hence, such amorphous alloy material having magnetic properties predetermined in advance can be obtained by rapidly cooling the component material to room temperature, after the component material has been heat-treated for a predetermined period at the temperature $T_A$.

Another undesirable characteristic is that, since these amorphous alloy materials in general exist in a metastable state, irrespective of the fact that they have been annealed through the conventional method, these materials suffer such magnetic aftereffects as the so-called disaccommodation (D.A.) of the consequent material. These deficiencies have been big barriers for useful application of these materials.

SUMMARY OF THE INVENTION

Accordingly, an essential object of the present invention is to provide a method for heat-treating amorphous alloy films, which can improve not only the magnetic properties of the amorphous alloy materials, but also their consequent aging stabilities.

Another object of the present invention is to provide such method as described above, which can especially make it possible to enhance the permeability of such amorphous material having a Curie temperature (Tc) higher than its crystallization temperature (Tx).

A further object of the present invention is to provide such method as described above, which can overcome all the disadvantage inherent in the prior art described in the foregoing.

In accomplishing these and other objects according to one preferred embodiment of the present invention, there is provided a method for heat-treating amorphous alloy films, in which an amorphous alloy film is heat-treated in the presence of a directed magnetic field. The directed magnetic field includes a vertical magnetic field whose direction is substantially vertical with respect to the plane of the film, a rotating magnetic field whose direction is being rapidly changed within a parallel plane with respect to the plane of the amorphous alloy film, etc. As for the rotating magnetic field, the relative rotation speed of the rotating magnetic field is not so critical and lies in the range of 500 to 10000 r.p.m. The strength of the magnetic field lies in the range of 1000 to 15000 Oe subject to the thickness of the film of amorphous alloy material. As for the film of amorphous alloy material, which has already been annealed at a temperature ($T_A$) satisfying the relation $Tc<T_A<Tx$, if the present heat-treating method as described above is further applied to the consequent film, the film does not suffer any degradation of the magnetic properties, and their stabilities can be extremely improved. Furthermore, according to another preferred embodiment of the present invention, the method comprises the steps of heat-treating the amorphous alloy film at a temperature less than its Tc in the presence of the vertical magnetic field and heat-treating the amorphous alloy film at a temperature less than its Tc in the presence of the rotating magnetic field. Such method as described above improves not only the magnetic properties of the amorphous alloy films, but also their consequent stabilities. Especially, this latter embodiment is quite effective for such amorphous alloy materials wherein $Tc>Tx$, to enhance the permeabilities of such amorphous alloy materials.

BRIEF DESCRIPTION OF THE DRAWINGS

These and other objects and features of the present invention will become apparent from the following description taken in conjunction with the preferred example thereof with reference to the accompanying drawings in which.

DETAILED DESCRIPTION OF THE INVENTION

Figure 1:
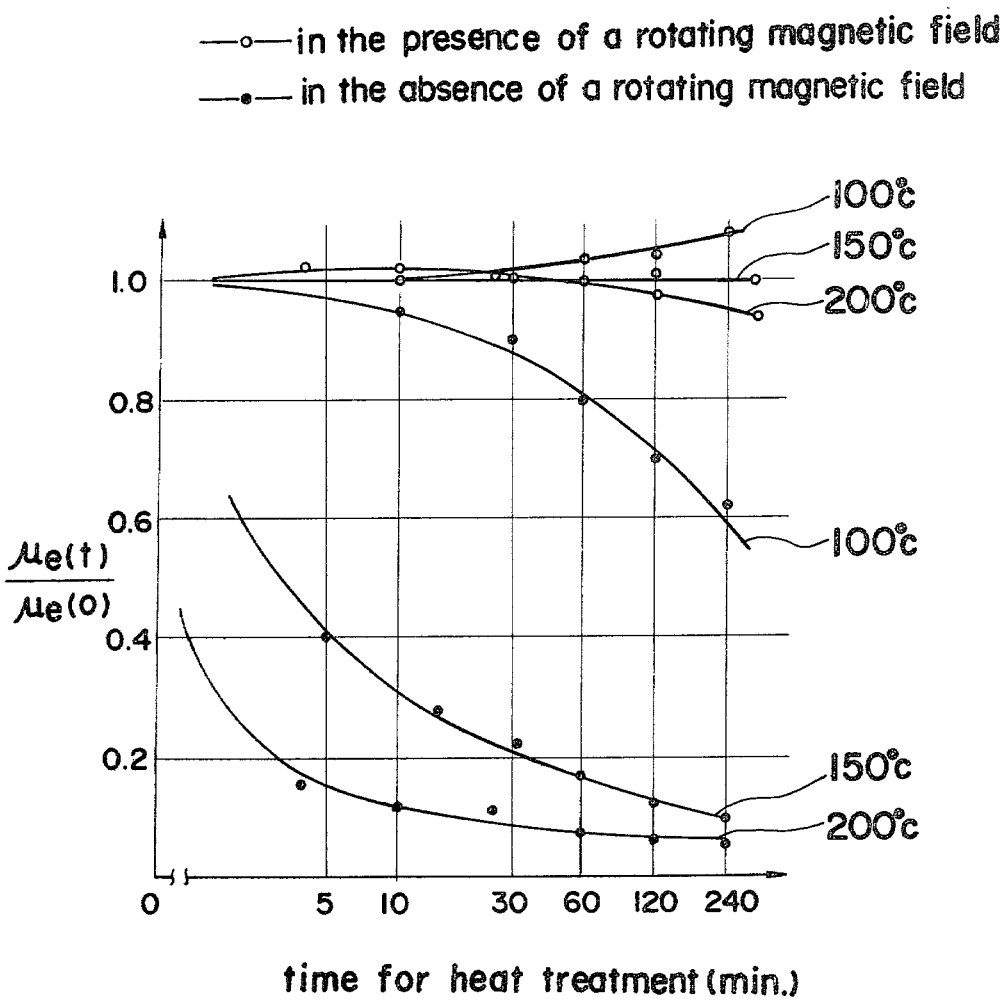
FIG. 1 is a plot of the relative permeability of an amorphous alloy as a function of the heating period in either the presence or the absence of a magnetic field with rapidly changing direction (the rotating magnetic field), for various heat treating temperatures.

With respect to the amorphous alloys, differing from widely used crystalline magnetic materials such as the Sendust, Permalloys and the like, magnetic amorphous alloys suffer disaccommodation (D.A.), which is commonly observed as an inherent characteristic of ferrite. In addition to such defect, the amorphous alloys suffer thermal degradation. Namely, when these alloys are retained under a temperature condition within 150° to 350° C. even for a short period, their magnetic properties are extremely degraded. As a matter of fact, when the magnetic core of a recording head is constituted by the amorphous alloy material, the process for laminating sheets of magnetic amorphous alloys with a bonding agent can not exclude such heating treatment step, which must be carried out in the temperature range of 150° to 350° C. Accordingly, the above described thermal defect will substantially exist as a substantial barrier against proper application of these materials.

More specifically, amorphous alloy material, which has a composition of $Fe_5Co_{70}Si_{15}B_{10}$, a Curie temperature of approximately 370° C. and a crystallization temperature of approximately 500° C., was chosen as a sample material, and the following experiments were carried out. According to one of the experimental runs, after the effective permeability of the sample without heat treatment was measured, the sample was retained for 4 hours at 150° C. in the presence of a magnetic field whose direction is rapidly changed within a parallel plane with respect to the plane of the sample (hereinafter referred to as a rotating magnetic field). Although the details will be described hereinafter, the relative rotation speed of the rotating magnetic field is not so critical and was in the range of 500 to 10,000 r.p.m. The strength of the rotating magnetic field was varied in the range of 3000 to 15,000 Oe subject to the thickness of the sample material. By way of example, the strength was 10,000 Oe for the sample material whose thickness was 40 μm. However, as long as the sample was made by laminating the sample material as having a thickness of 40 μm, the strength of the rotating magnetic field was the same. In contrast, in another experimental run, after the effective permeability of the sample without heat treatment was measured, the sample was retained for 4 hours at 150° C. and then, the effective permeability of the consequent sample was measured. According to the latter case, the heat treatment of the sample was carried out in the absence of the rotating magnetic field. Results are listed in Table 1. In the experiments, the permeability measurements were carried out by the use of the Maxwell bridge at a frequency of 1 KHz.

TABLE 1

| rotating magnetic field | effective permeability μe (without heat treatment) | | effective permeability μe (4 hrs. heat treatment at 150° C.) | |
|---|---|---|---|---|
| | before demagnetization | after demagnetization | before demagnetization | after demagnetization |
| present (the present invention) | 12000 | 17000 | 17000 | 17000 |
| none (the comparison run) | 12000 | 17000 | 1200 | 2100 |

When the disaccommodation was defined by the following expression, $$D.A. = \frac{\mu e\text{ (after demagnetization)} - \mu e\text{ (before demagnetization)}}{\mu e\text{ (after demagnetization)}} \times 100(\%) \quad (1)$$

the D.A. of the sample without heat treatment was 29.4%. Furthermore, the sample which was heat-treated in the absence of the rotating magnetic field showed a relatively large D.A. value of 42.9%, whereas the sample which was heat-treated in the presence of the rotating magnetic field according to the present method showed a D.A. value of zero. With respect to the effective permeability $\mu e$, according to the results obtained from the comparison runs, the samples which were heat-treated show considerably lower values when compared with those shown by the samples without heat-treatment. However, according to the results obtained according to the present method, the samples do not suffer the thermal degradation at all as can be easily seen from Table 1.

As is clear from the experimental results described above, according to the present heating method, the amorphous alloys do not suffer the thermal degradation, even if the processing of the amorphous alloys includes such heating step as described earlier. Thus, the substantial barriers against proper application of these materials are effectively taken away, as long as the present method is introduced for such heating purpose. Furthermore, the amorphous alloys obtained through the conventional splat cooling method normally have comparatively large D.A. values. According to the conventional techniques, the D.A. value of the amorphous alloy material can not be controlled in a manufacturing process, which results in a wide scattering of the D.A. values of consequent alloys. Such scattering as described above is quite undesirable from a standpoint of material design and has restricted the application of the amorphous alloy materials, in spite of their specific relevant properties. The present invention can thus cope with such undesirable problems in quite a handy manner.

Figure 2:
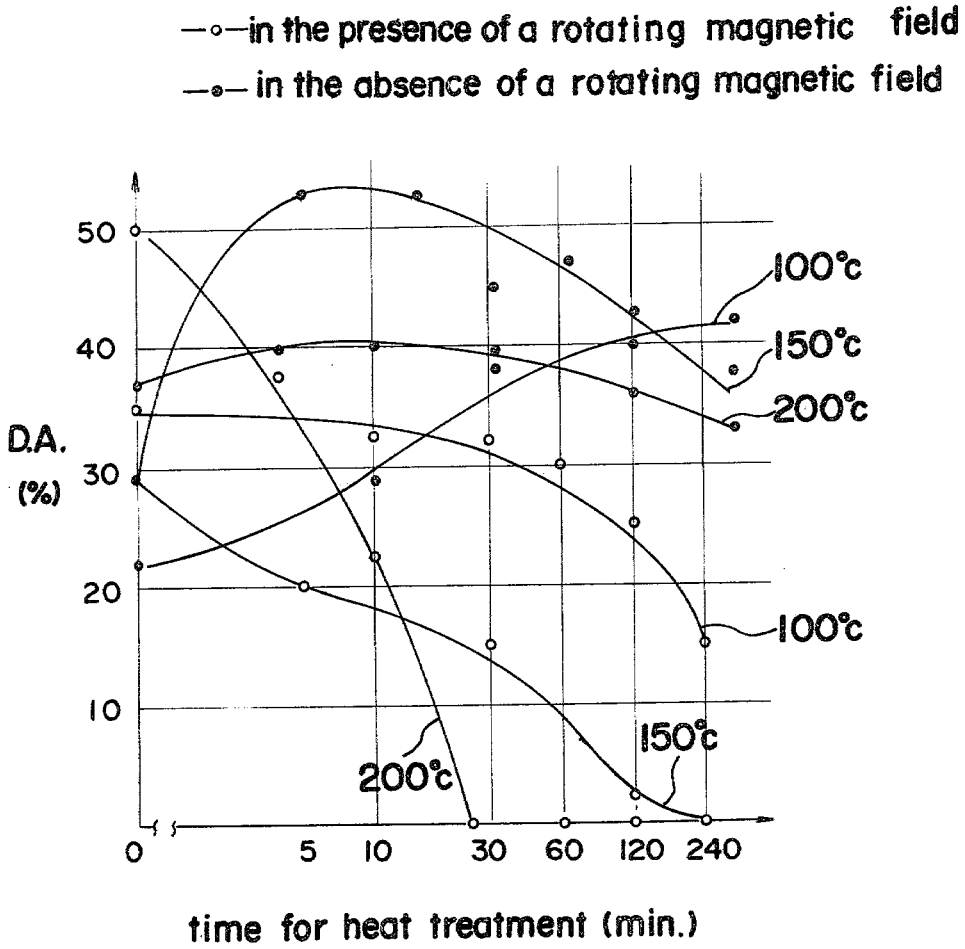
FIG. 2 is a plot of the disaccommodation of an amorphous alloy as a function of the heating period in either the presence or the absence of a rotating magnetic field, for various heat treating temperatures.

Referring now to FIGS. 1 and 2, there are shown respective plots of the relative permeability and the disaccommodation (D.A.) of an amorphous alloy material with respect to a heating period. In these experiments, three heating conditions of 100° C., 150° C., and 200° C. were chosen, while each experiment at a fixed temperature was carried out in either the presence or absence of the rotating magnetic field.

As is clear from these results, when the amorphous alloy is heated without application of the rotating magnetic field, the stability of the specific properties of the amorphous alloy become worse as the temperature of the heating condition becomes higher. This depends upon the fact that the relaxation time $\tau$ of the thermal degradation is subject to the relation $$\tau \propto \exp.\ (Q/kT) \qquad (2)$$

where k: Boltzmann's constant

Q: activation energy

T: temperature.

Furthermore, according to the present method, in which the sample material is heat-treated (or heated) in the presence of the rotating magnetic field, the permeability substantially remains constant, whereas the disaccommodation (D.A.) correspondingly decreases in accordance with the relaxation time as predicted by the equation (2). The latter fact shows that in order to eliminate or lower the D.A., the heating period becomes longer as the temperature of the heating treatment is lower. Accordingly, from a standpoint of practical application, such heating treatment of the amorphous alloy materials as being necessary for laminating the sheets are preferably executed at a temperature higher than 100° C. in the presence of the rotating magnetic field. In addition, in order to effectively accomplish the present method described above, it is important that the heating treatment of the amorphous alloy material should be carried out at a specific temperature below its Curie temperature, at which the amorphous alloy material to be heat-treated will gain specific magnetic properties subject to the presence of the rotating magnetic field. As described above, in accordance with the elevation of the heating temperature, the relaxation time will be shortened as can be predicted by the equation (2). Therefore, it is essential that the heating treatment should not be carried out at a temperature that would make the relaxation time substantially equivalent to the time required for one relative rotation of the rotating magnetic field with respect to the sample material. Namely, the present invention provides a method, which not only prevents the occurrence of the magnetic anisotropy induced during the heating treatment by relatively rotating the magnetic field, but also can eliminate the inherent anisotropy of the amorphous material, thereby to decrease the D.A. of the material. The induced magnetic anisotropy can be considered to be caused by the re-orientation of atoms subject to the internal magnetization of the amorphous alloy material during the heating treatment. Accordingly, when the relaxation time becomes less than the time required for one relative rotation of the magnetic field, there is no benefit in applying such rotating magnetic field, with an undesirable result that the induced magnetic anisotropy is quite remarkable in one specific direction in the plane of the material. When an amorphous film is heat-treated in the presence of a magnetic field whose direction lies in the plane of the film, the following results can be obtained for different temperature conditions. Namely, the thermal degradation of the permeability is comparatively small under the temperature condition of 150° C., while it is extremely degraded under the temperature condition of 200° C. For both cases, respective values of D.A. rather increase, when compared with those having been obtained prior to heating. By way of example, the thermal degradation experiments were carried out for an amorphous material having a composition of $Fe_5Co_{70}Si_{15}B_{10}$. Samples were held for one hour at 200° C., and the results are listed in Table 2. For the heat treatment in the presence of the rotating magnetic field, the strength of the magnetic field was 3000 Oe, while that for the heat treatment in the presence of the magneticfield whose direction lies in the plane of the sample was 3000 Oe.

TABLE 2

| | Before heat treatment | | | After heat treatment (1 hour, at 200° C.) | | |
|---|---|---|---|---|---|---|
| | effective permeability | | | effective permeability | | |
| | after demagnetization | before demagnetization | D.A. (%) | after demagnetization | before demagnetization | D.A. (%) |
| rotating magnetic field (the present invention) | 10000 | 20000 | 50 | 20000 | 20000 | 0 |
| magnetic | 15000 | 18000 | 16.7 | 4000 | 6000 | 33.3 |

TABLE 2-continued

| | Before heat treatment | | | After heat treatment (1 hour, at 200° C.) | | |
|---|---|---|---|---|---|---|
| | effective permeability | | | effective permeability | | |
| | after demagnetization | before demagnetization | D.A. (%) | after demagnetization | before demagnetization | D.A. (%) |
| field whose direction lies in the sample plane (the comparison run) without application of magnetic field (the comparison run) | 12000 | 19000 | 36.8 | 900 | 1400 | 35.7 |

As is clear from the results listed in Table 2, the present method is much superior to such conventional method as that where the amorphous alloy film is heat-treated in the presence of the magnetic field whose direction lies in the plane of the film.

Figure 3:
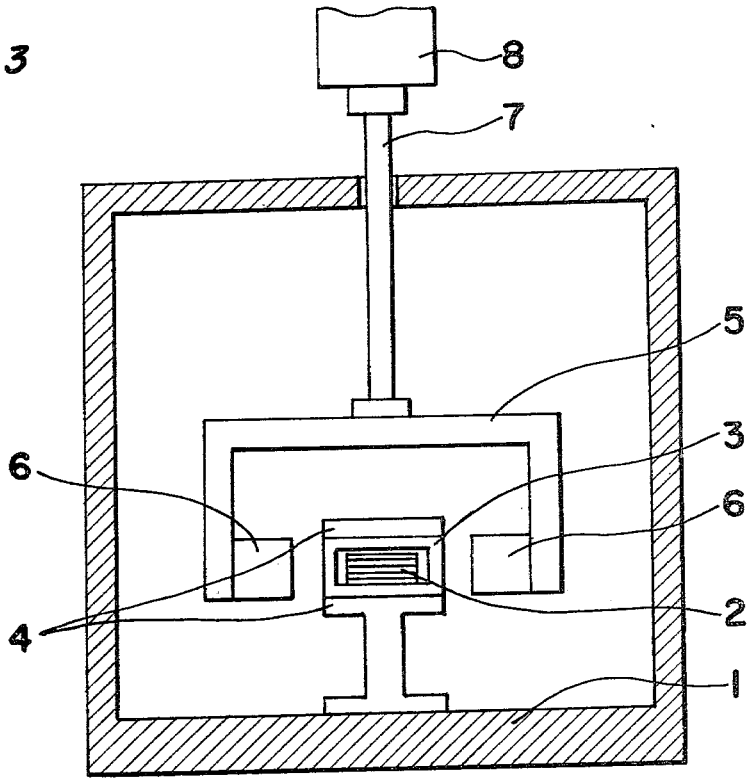
FIG. 3 is a partial cross sectional view of one embodiment of an apparatus which can be used for carrying out the heat-treating method in the presence of a rotating magnetic field according to the present invention.

Referring now to FIG. 3, there is shown an apparatus which can be used to practice the present invention. The apparatus includes a thermostatic chamber 1. Inside the thermostatic chamber 1, there is provided a casing holder 4 whose head portion holds a sample casing 3 accommodating amorphous alloy films 2. Both the sampling casing 3 and the casing holder 4 are made of a non-magnetic material. Numeral 5 designates a U-shaped member of iron. Each arm portion of the U-shaped member 5 is provided with a magnet 6 of high magnetizing force on its inner end portion, while the middle of the portion interconnecting the two arms is integrally connected to one end of a driving shaft 7. The driving shaft 7 extends outside the thermostatic chamber 1 and is incorporated in a driving motor 8 at its other end portion. As can be seen in FIG. 3, the paired magnets 6 are relatively spaced apart from respective lateral sides of the sample casing 3 in a manner such that these magnets 6 can move around the sample casing 3 accommodating the magnetic amorphous alloy (films) 2 therein in accordance with the rotation of the U-shaped member 5.

By the arrangement as described above, the amorphous alloy films 2 can be retained at a predetermined temperature below their Curie temperature in the presence of the rotating magnetic field.

In addition to the above described apparatus, the rotating magnetic field for the above described purpose can be generated with a means, which is stationary relative to the amorphous alloy films. Namely, the means, which includes a stator spirally wound with coils and being impressed by an alternating current, is adapted to surround the amorphous alloy films.

In the description hereinabove, there is provided a method of heat treating amorphous alloys with high permeabilities at specific temperatures less than their respective Curie temperatures, which can make it possible to prevent occurrence of the thermal degradation of the magnetic properties of the alloys, subject to application of the rotating magnetic fields onto the alloys. In addition, the present inventors have already found the following novel phenomena during a series of research work. The research work was directed to improve the instability of the magnetic properties of the amorphous alloys, which is shown by amorphous alloy materials retained at a temperature less than their Curie temperature.

(1) Subject to the presence of a magnetic field whose direction is vertical with respect to the plane of the amorphous alloy film, the permeability of the film is not thermally degraded, even if the film is retained at a temperature below its Curie temperature.

(2) The thermally degraded permeability of the amorphous alloy film can be restored, if such alloy having the thermally degraded permeability is again heat-treated at a certain temperature in the presence of the magnetic field whose direction is vertical with respect to the plane of the film. Here, the heat-treating temperature described above corresponds to a temperature which has caused the thermal degradation of the permeability of the film.

(3) The consequent amorphous alloy materials treated as described in item (1) or (2) can show such respective thermal stabilities as those which can be shown by respective corresponding materials which have been annealed at respective temperatures above their Curie temperatures in the absence of the magnetic field.

In the following, the present invention based upon the phenomena as described above will be explained by way of examples with reference to the accompanying drawings.

(EXAMPLE 1)

An amorphous magnetic alloy film was obtained by quenching material having a composition of $(Fe_{4.6}Co_{70.4})$ 76/75 $Si_{12}B_{12}$ through the splat cooling method of the single roller type. Dimensions were 40 μm in thickness and 3 cm in width. Annularly shaped samples each having an outer diameter of 8 mm and an inner diameter of 4 mm were obtained from the ribbon through the blanking work. These samples were divided into four groups of A, B, C and D.

Figure 4:
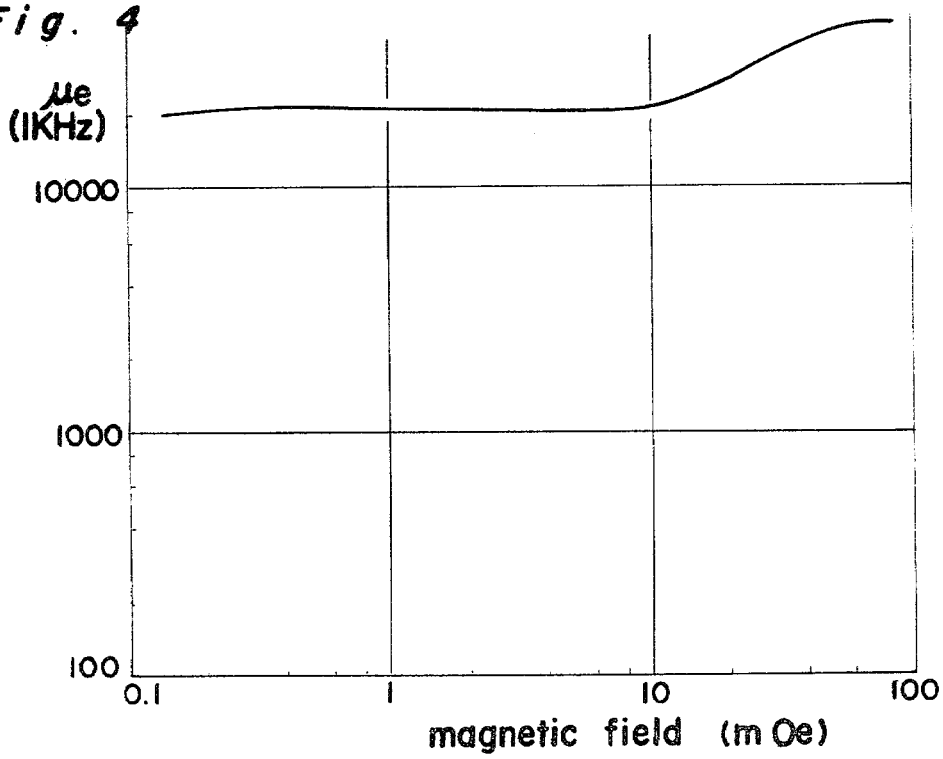
FIG. 4 is a plot of the effective permeability level characteristic of an amorphous alloy, which is heat-treated at a temperature $T_A$ satisfying the relation of $Tc<T_A<Tx$, as a function of the measured magnetic field strength, as measured by the use of a Maxwell bridge at a frequency of 1 KHz.

These samples A, B, C and D were first heat-treated for ten minutes at 462° C. and then, were rapidly cooled down to a room temperature. Ten sheets of each sample were laminated and wound with winding wires of 15 turns, thereby to prepare an experimental sample. The permeability of each experimental sample was measured as a function of the magnetic field by the use of the Maxwell bridge at a frequency of 1 KHz. The experimental results are shown in FIG. 4. Namely, each experimental sample showed the same result.

With respect to sample A, it was heat-treated for two hours at 200° C. in the presence of the magnetic field whose direction is substantially vertical with respect to the plane of the sample (the laminated sheet surface). The strength of the magnetic field was 7000 Oe. Afterwards, the permeability of the consequently heat-treated sample was measured as a function of the measured magnetic field by the use of the Maxwell bridge at a frequency of 1 KHz. The measuring result is shown with a dot and dash line in FIG. 5.

For the sake of the comparison, sample B was heat-treated for two hours at 200° C. in the presence of the magnetic field whose direction is parallel with respect to the plane of the sample, while sample C was heat-treated at the same heat-treating condition but omitting application of the magnetic field. The strength of the parallel magnetic field described above was 7000 Oe for each run. Respective permeabilities of consequently heat-treated samples were measured under the same measuring condition as described above. The measuring result of the experimental sample B is shown with a broken line in FIG. 5, while that of the experimental sample C is shown with a solid line.

Figure 5:
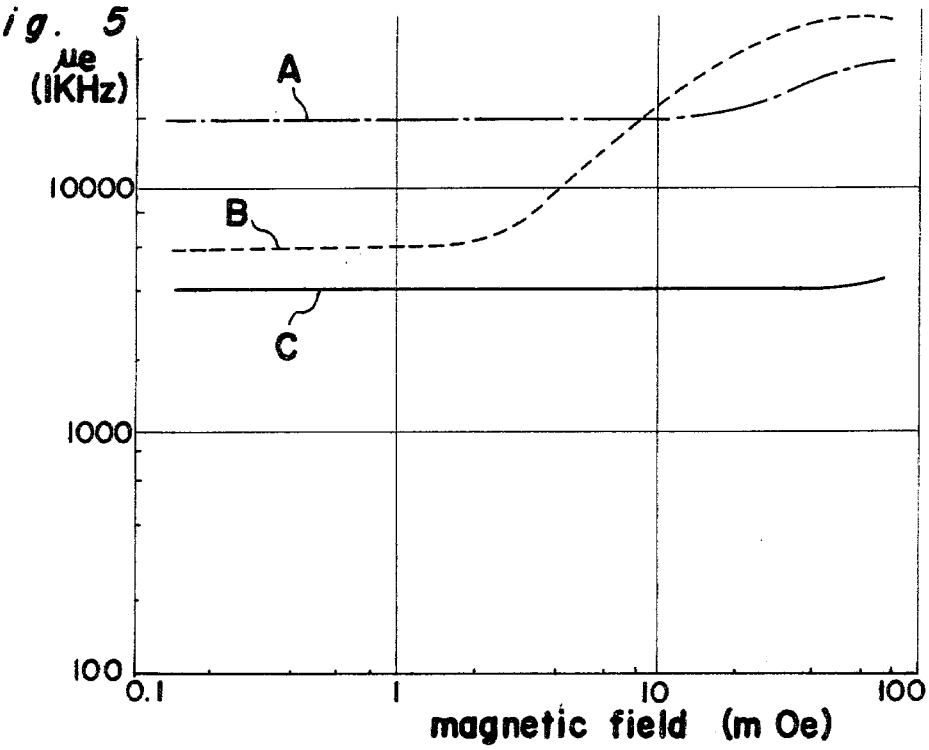
FIGS. 5 to 9 are respective plots each exemplifying the effectiveness of the present invention in comparison with the conventional method, where each is a plot of the permeability of an amorphous alloy as a function of the measured magnetic field strength as measured by the use of the Maxwell bridge at a frequency of 1 KHz.

As is clear from the results shown in FIG. 5, the permeability of the experimental sample C, which was heat-treated in the absence of the magnetic field, is, as a whole, lower than the rest. With respect to the permeability level of the experimental sample B which was heat-treated in a parallel magnetic field, it is flat in the smaller range of the measured magnetic field strength, whereas it is considerably increased as the measured magnetic field strength is increased. More specifically, the permeability of the experimental sample B is considerably affected by the strength of the measured magnetic field.

On the other hand, the experimental sample A, which was heat-treated according to the present method, does not show any decrease over the entire range of the measured magnetic field. When the magnetic core of a recording head is constituted by the elements of the amorphous alloy material, the material used for this purpose is correspondingly required to have a high permeability under a rather lower measured magnetic field strength. Accordingly, the heat-treating method of the present invention is quite effective, when such materials as having such characteristics described above must be manufactured.

Figure 6:
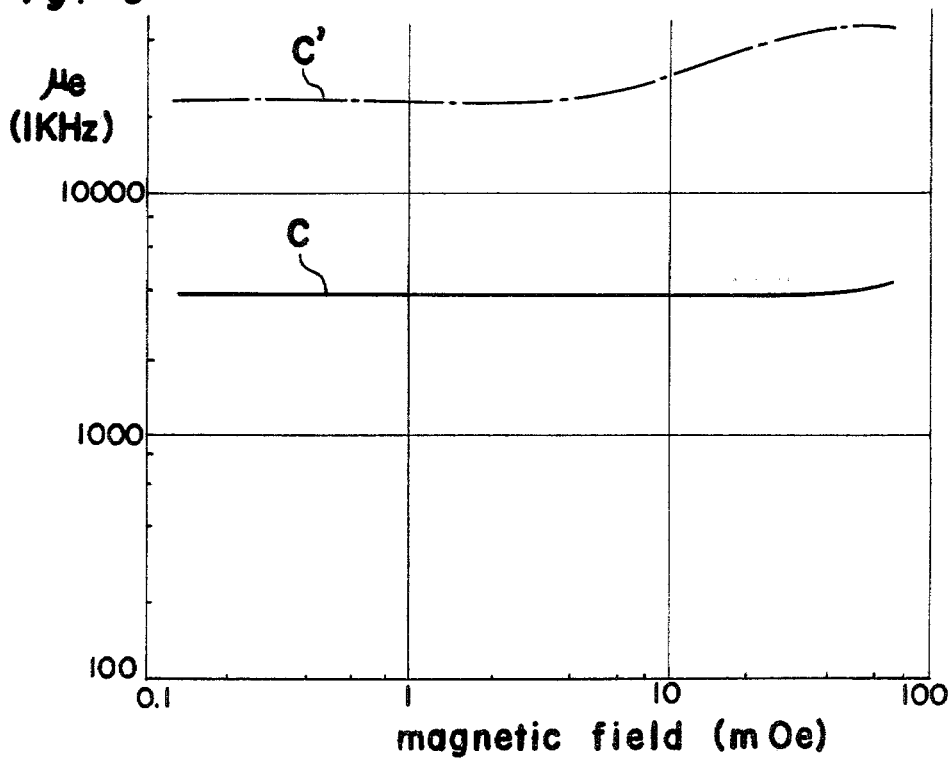

The present method was applied to the sample C, thereby to confirm the effectiveness of the present invention. Namely, the experimental material C was heat-treated for two hours at 200° C. in the presence of the magnetic field whose direction is perpendicular or vertical with respect to the plane of the sample. The strength of the magnetic field was 7000 Oe. Afterwards, the permeability of consequently heat-treated sample C' was measured as a function of the magnetic field by the use of the Maxwell bridge at a frequency of 1 KHz. The measured result is shown with a dot and dash line in FIG. 6. For the sake of comparison, the aforesaid result of the experimental sample C is also shown with a solid line in FIG. 6. As is clear from FIG. 6, the thermally degraded permeability of the amorphous alloy material can be restored, if such alloy material as having the thermally degraded permeability is again heat-treated at the heat treating temperature in the vertical magnetic field. More specifically, the findings as described in the items (1) and (2) above are here confirmed. Namely, according to the present method, the thermally degraded magnetic characteristics of the amorphous alloy material can be restored and thus, the present invention can contribute to make it possible to effectively use relevant, specific characteristics of the amorphous alloy material.

Figure 7:
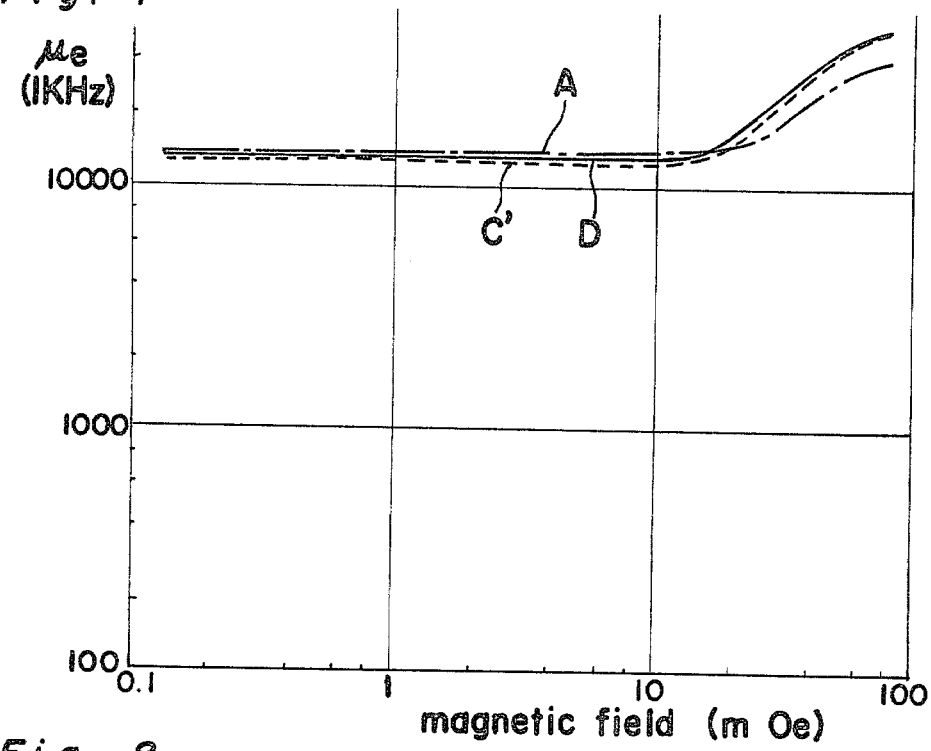

With respect to experimental samples A, and C', which have already been applied by the present method, accelerated tests were executed, respectively, thereby to confirm their magnetic stabilities under normal service conditions. In the accelerated tests, these experimental samples A and C' are retained for twenty-four hours at 70° C. Respective permeabilities of the consequently heat-treated samples were measured as a function of the magnetic field by the use of the Maxwell bridge at a frequency of 1 KHz. Results are shown in FIG. 7. Judging from the results shown in FIG. 7, the respective permeability levels only show relatively small decreases. These results further confirmed that once the amorphous alloy materials are heat-treated according to the present invention, there is not much fear that the degradation of the permeability of the alloy material will be effected, when appliances made of the amorphous alloy material are in use. Furthermore, as shown in FIG. 7 the permeability levels of A and C' are not different from that of D, which was annealed through the conventional method described earlier. Thus, the effective magnetic characteristics concerning the amorphous alloy materials, which are caused by the application of the present method to respective samples A and C', are kept unchanged even after the accelerated tests.

(EXAMPLE 2)

Annularly shaped samples were obtained from the same amorphous alloy film as described in EXAMPLE 1. These samples were first heat-treated for ten minutes at 462° C. and then, were rapidly cooled down to the room temperature. Such samples as heat-treated were divided into three groups of E, F and G. The sample E was heat-treated for eight hours at 150° C. in the presence of the magnetic field whose direction is vertical with respect to the plane of the sample. The strength of the magnetic field applied for the sample E was 7000 Oe. The sample F was heat-treated for eight hours at 150° C. in the presence of the magnetic field whose direction is parallel with respect to the plane of the sample. The sample G was heat-treated for eight hours at 150° C. in the absence of the magnetic field.

Figure 8:
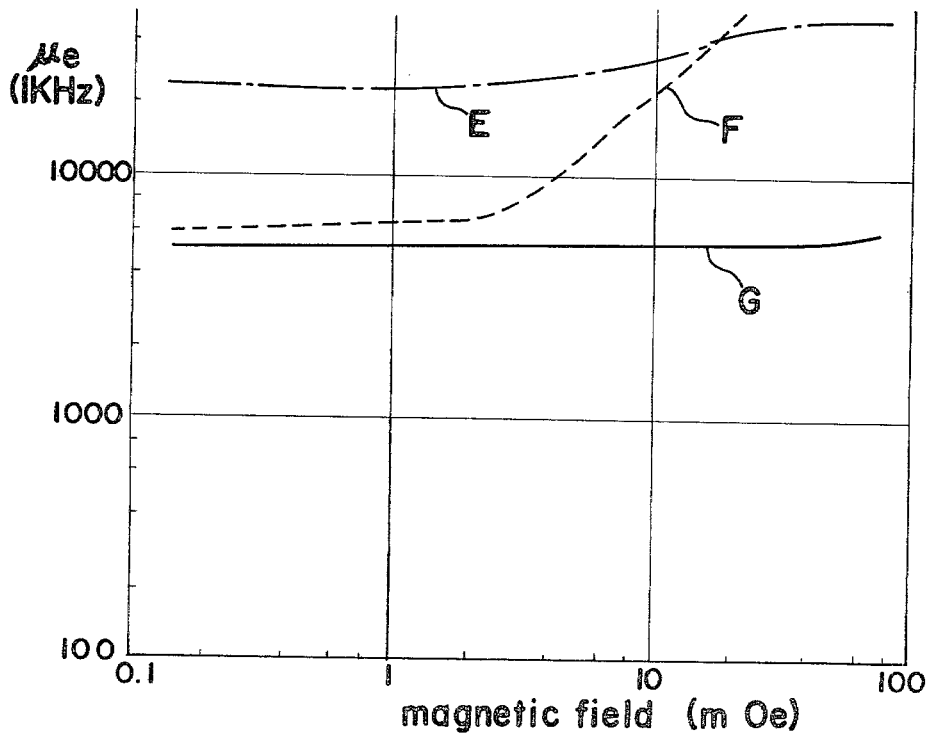

With respect to these consequently heat-treated samples, respective permeabilities were measured as a function of the magnetic field by the use of the Maxwell bridge at a frequency of 1 KHz. The results are shown in FIG. 8 and these are denoted by E, F, and G, respectively. As can be seen from this figure, the permeability of the sample E is considerably large over the entire range of the measured magnetic field strength when it is compared with those of the respective samples F and G. Furthermore, the permeability level characteristic of the sample E is also quite flat.

(EXAMPLE 3)

Annularly shaped samples were obtained from the same amorphous alloy film as described in EXAMPLE 1 through the blanking operation. These samples were first heat-treated for ten minutes at 462° C. and then, were rapidly cooled down to the room temperature. Such samples as heat-treated were divided into two groups of H and I. These samples were further heat-treated for an hour at 250° C. and then, were cooled down to room temperature. Successively, the sample I was heat-treated for an hour at 250° C. in the presence of the magnetic field whose direction was perpendicular with respect to the sample. The strength of the magnetic field applied to the sample was 7000 Oe. After the aforesaid heat-treatment for one hour, the sample was cooled down to the room temperature.

Figure 9:
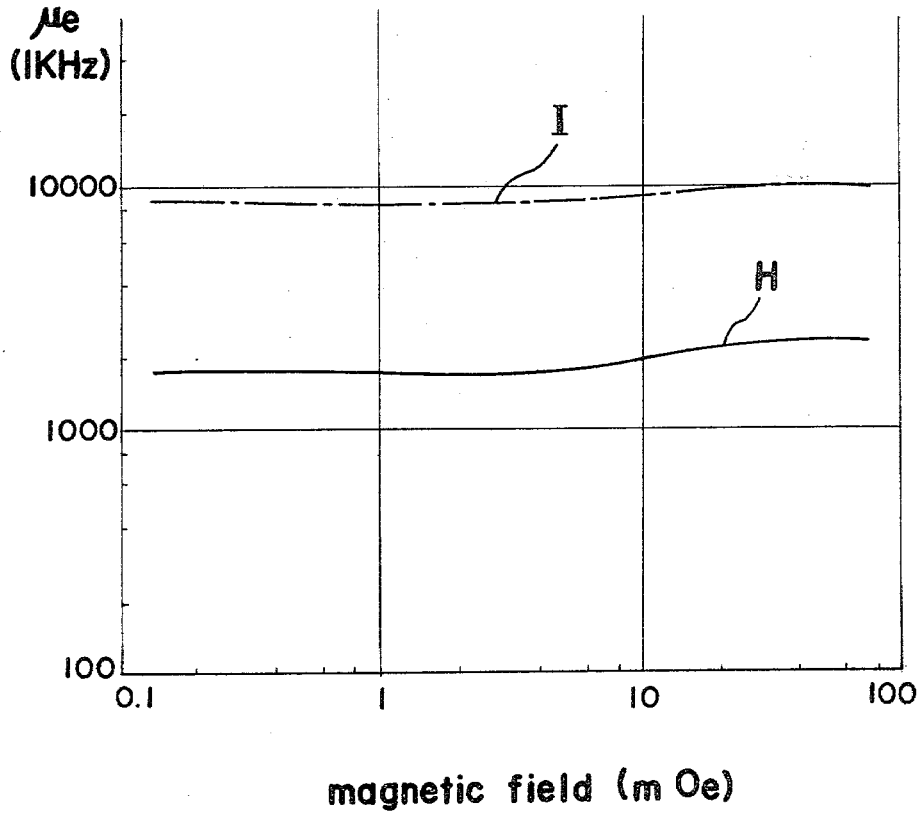

With respect to these consequently heat-treated samples H and I, the measurement was made for respective permeabilities by the use of the Maxwell bridge at a frequency of 1 KHz. The measuring results were shown in FIG. 9 and these are denoted by H and I, respectively. As can be seen in FIG. 9, these samples respectively show quite preferable permeability levels.

As described hereinabove, application of the magnetic field for the heat-treatment of the amorphous alloy film is restricted to a direction perpendicular to the plane of the film according to the present method. Accordingly, the consequently heat treated films not only have respectively high permeabilities, but also show preferable permeability levels. In addition, with respect to such amorphous alloy film as having the thermally degraded permeability, the present method can make it possible not only to restore the thermally degraded permeability but also to improve the permeability level. Consequently, even if the amorphous alloy film can not help being heat-treated during either a manufacturing process or an application process of the film, there is not much fear that the permeability characteristics will be degraded according to the present invention. Furthermore, the present method can even restore the permeability characteristics, which have once been thermally degraded.

The aforesaid heat-treatment in the presence of the magnetic field relates to the improvement of thermal stability of the magnetic properties of such specific amorphous alloy as that which can satisfy the following relationship. Namely, such specific amorphous alloy as described above must have the annealing temperture ($T_A$) lying above its Curie temperature (Tc).

$$Tc < T_A < Tx \quad (3)$$

Figure 10:
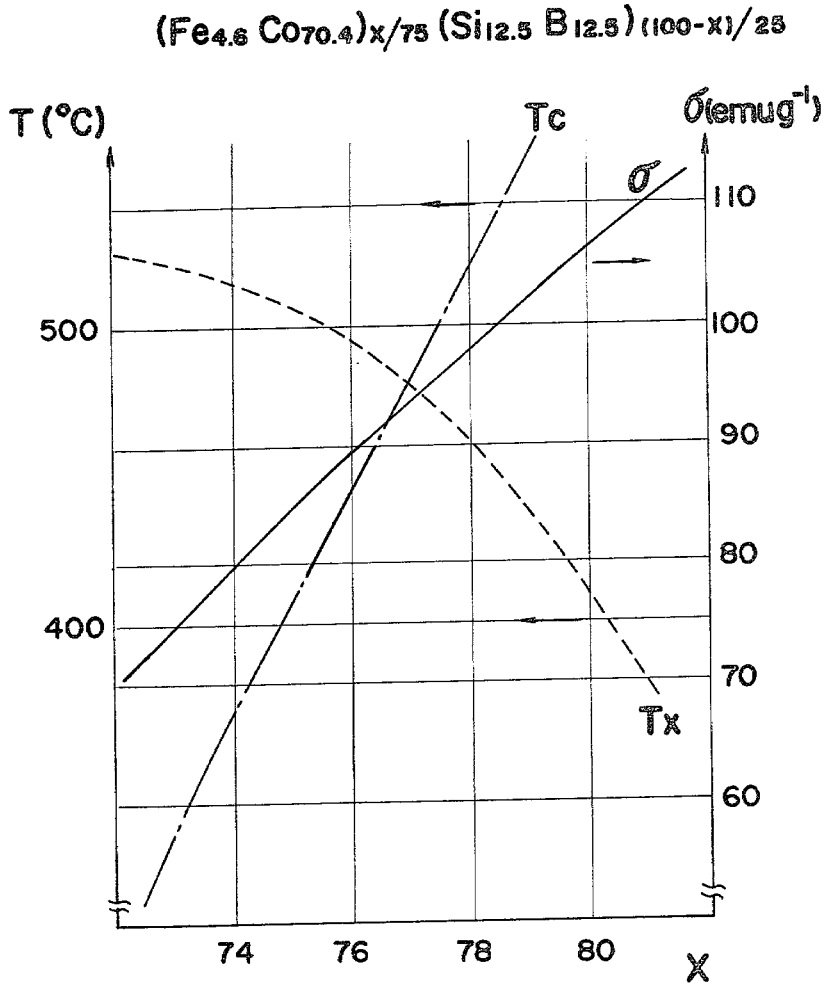
FIG. 10 shows plots of the Curie temperature, the crystallization temperature and the saturation magnetization as a function of the relative substituting amount of the transition metals in an amorphous alloy having a nominal composition of $(Fe_{4.6}Co_{70.4})_{x/75}(Si_{12.5}B_{12.5})_{(100-x)/25}$.
Figure 11:
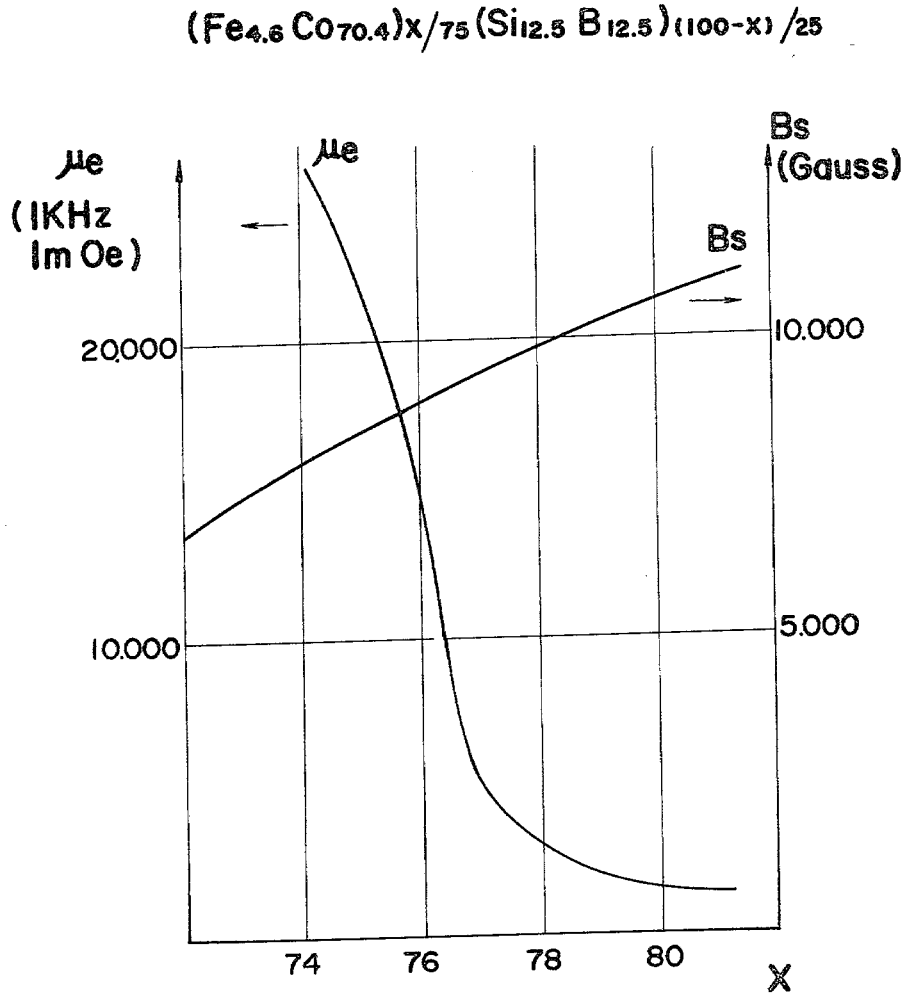
FIG. 11 shows plots of the effective permeability measured by the use of the Maxwell bridge at a frequency of 1 KHz and the saturation magnetic flux density as a function of the amount of the transition metals in the same amorphous alloy as shown in FIG. 10.

However, it is quite difficult to obtain the consequent amorphous alloys, which can satisfy the relationship (3). Most of the amorphous alloys are each characterized in that their Curie temperature (Tc) and crystallization temperature (Tx) are quite close to each other. Especially, a recently developed amorphous alloy system mainly comprising a magnetic element Co has a quite high permeability and small magnetostriction, so that the system is easily applicable for the production of the electrical appliances including magnetic heads. In such alloy system, it is well known that the magnetic saturation flux density (Bs) is approximately proportional to the Curie point (Tc), while being approximately reversely proportional to the crystallization temperature (Tx). Such being the case, as the composition of an alloy is so arranged as to have a higher Bs, the difference between Tx and Tc becomes smaller. Thus, finally, the value of Tc and that of Tx coincide with respect to each other, when the value of Bs exceeds approximately 9500 gauss. However, beyond the value of approximately 9500 gauss, the relationship between Tc and Tx is reversed and then, the relationship of Tc > Tx is compatible between them, whereby the possible annealing condition of the alloys is no longer satisfied. Therefore, according to the conventional heat-treating methods, it has not been possible to obtain such amorphous alloys which are both magnetically stable and have a high permeability, while these alloys have respective Bs values more than 10000. The features as stated above are graphically shown in FIGS. 10 and 11 by introducing a typical amorphous alloy of non-magnetostriction, which has a nominal composition of $(Fe_{4.6}Co_{70.4})_{x/75}(Si_{12.5}B_{12.5})_{(100-x)/25}$. Among the amorphous alloys having such nominal composition as described above and having the effective permeability more than 10000 at a frequency of 1 KHz, the condition of which is indispensable for the amorphous alloys to be practically applied for magnetic heads of audio-appliances, the amorphous alloy having the highest Bs corresponds to that having a Bs of approximately 9000 gauss in FIG. 11. Thus, as is clear from the description hereinabove, it has been not possible to obtain such amorphous alloys which are magnetically stable and have a high permeability with Bs value more than 10,000 as described.

Figure 12:
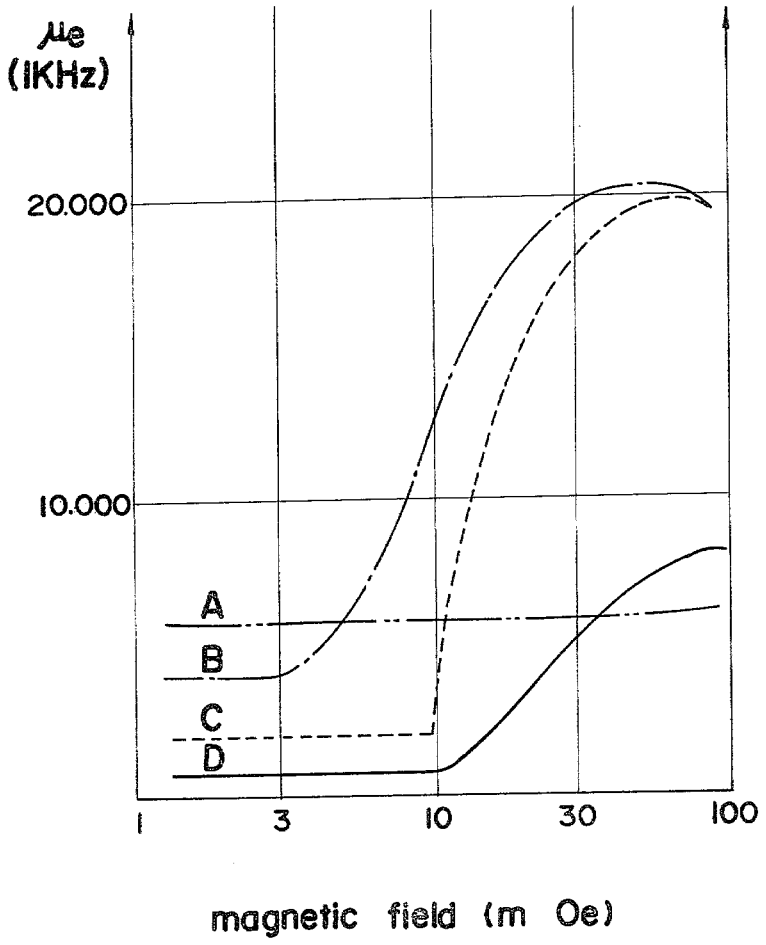
FIG. 12 is a plot of the effective permeability level characteristic of an amorphous alloy having respective values of Tc=550° C. and Tx=420° C. as a function of the measured magnetic field strength, as measured by the use of the Maxwell bridge at a frequency of 1 KHz, in which samples of amorphous alloy were heat-treated in three different ways, i.e. a heat treatment for 30 minutes at 220° C. in the presence of a vertical magnetic field of 5000 Oe, a heat treatment for 30 minutes at 220° C. in the presence of a rotating magnetic field of 2000 Oe and a heat treatment for 30 minutes at 220° C. in the presence of a parallel magnetic field of 2000 Oe.

However, the present inventors have already confirmed a method, which can provide the amorphous alloys having such magnetic characteristics as described above, in which the two kinds of the heat-treating methods described in the foregoing are combined. This heat-treating method of the present invention is especially effective for the amorphous alloy system having property characteristics of Tc > Tx, since the effective permeability of such amorphous alloy system has not been enhanced through either of the conventional annealing methods. It has already been known that when the film of amorphous alloy material is applied through the magnetic field whose direction lies in the plane of the film, the ratio of the residual magnetic flux density (Br) to the saturation magnetic flux density (Bs) becomes approximately one, with a result of the improvement of the consequent film. However, according to this method, such permeability of the amorphous alloy as can prevail through application of an alternating current can not be improved. Furthermore, the dependency of the permeability on the measured magnetic field strength is quite large. Namely, the amorphous alloys thus treated only show large dependency on measured field strength, the detailed feature of which is shown in FIG. 12.

Figure 13:
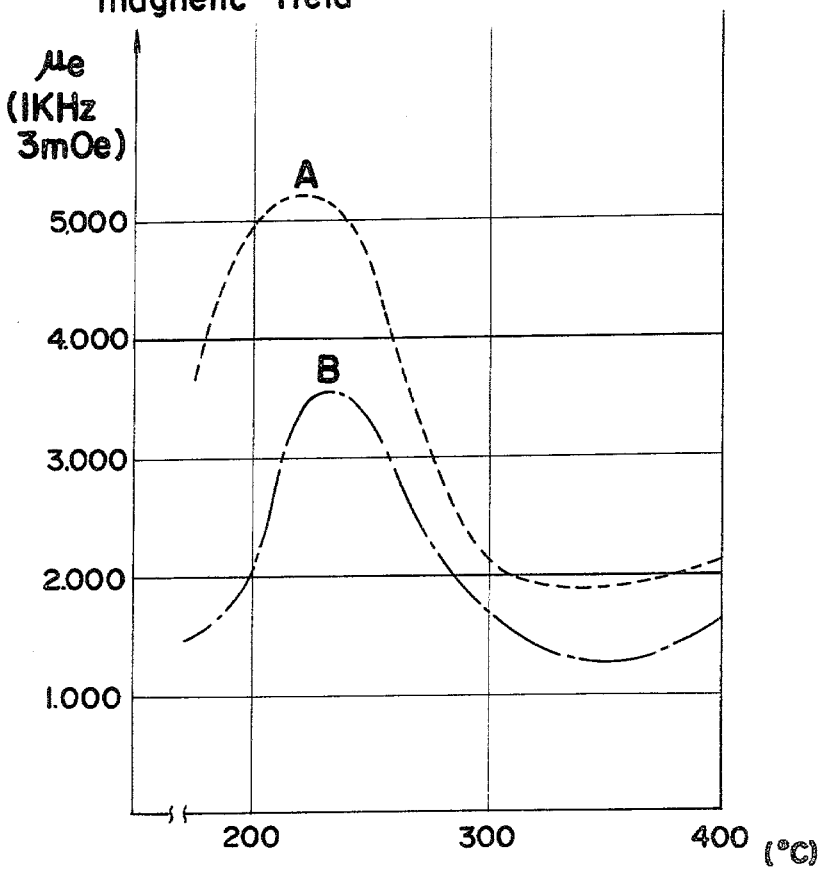
FIG. 13 is a plot of the effective permeability of an amorphous alloy having respective values of Tc=550° C. and Tx=420° C. as a function of the heat-treating temperature, in which a sample of amorphous alloy was heat-treated in the presence of either a rotating magnetic field or a vertical magnetic field, and the measurement was made under a measured magnetic field strength of 3 m Oe, as measured by the use of the Maxwell bridge at a frequency of 1 KHz.

On the other hand, the heat-treating of the amorphous alloy film in the presence of the rotating magnetic field is quite effective for the improvement of the permeability. However, this method is effective only for prevention of occurrence of the thermal degradation of the magnetic properties, when such amorphous alloy film as having been once annealed at a temperature $T_A$ satisfying the relation (3) must be heat-treated at a temperature lying below Tc. Namely, the heat treatment associated with application of the rotating magnetic field is effective for prevention of occurrence of the thermal degradation, but is not effective for enhancement of the magnetic properties. More specifically, this is due to the fact that the heat-treatment associated with application of the rotating magnetic field causes the permeability to be increased, while being influenced by the permeability level effected immediately after occurrence of the glassy state of the alloy material. Accordingly, when the strength of the measured magnetic field is large, an extremely high permeability can be rendered, whereas the permeability rendered in the initial state of the heat-treatment is not so high. Similarly, the heat-treating of the amorphous alloy film in the presence of a vertical magnetic field is also quite effective for the improvement of the permeability. However, this method is also effective only for the prevention of occurrence of the thermal degradation of the magnetic properties, when such amorphous alloy film as having been once annealed at a temperature $T_A$ satisfying the relation (3) must be heat-treated at a temperature lying below Tc. In addition, application of this method is effective, when the once thermally degraded permeability is restored. However, as far as such amorphous alloys having the property characteristic of Tc>Tx are concerned, sole application of this heat-treating method can not serve for the enhancement of the permeability at all. Nevertheless, this method has a preferable characteristic in that the permeability level consequently effected is rendered to be quite flat as shown in FIG. 12. As described earlier, sole application of the heat-treatment in the presence of the rotating magnetic field can not serve for effective improvement of the magnetic properties, whereas the method can be effective, if the method is combined with the conventional annealing method whose annealing temperature $T_A$ satisfies the relation of $Tc<T_A<Tx$. As for the amorphous alloy materials having the property of $Tc \geqq Tx$, it can be said that the improvement of the magnetic properties can not be effectively executed. Moreover, the magnetic properties of such amorphous alloy materials as stated above can not be improved, even if the heat-treating method, which is combined with the conventional heat-treating method, is either one of the aforesaid two magnetically heat-treating methods. Sole application of either of the two magnetically heat-treating methods to the amorphous alloy materials of Tc>Tx does not effect any improvement of the magnetic properties of these materials. Referring now to FIG. 13, there are shown a plot of the permeability obtained through the heat-treatment in the presence of the rotating magnetic field and that obtained through the heat-treatment in the presence of the vertical magnetic field as a function of the heat-treating temperature. The sample material has a composition of $(Fe_{2.5}Co_{71.5}Mn_3)_{80/77}Si_4B_{16}$, which is characterized in that the magnetostriction is quite small, and the following relation is satisfied i.e. Tc>Tx (=420° C.). The measurement was made for the respective permeabilities under the measured magnetic field strength of $3\times10^{-3}$Oe by the use of the Maxwell bridge at a frequency of 1 KHz. As is clear from the result shown in FIG. 13, respective permeability characteristics are improved in the vicinity of the heat-treating temperature of 200° C. However, above the aforesaid temperature of 200° C., the respective permeabilities are not so improved and, are drastically thermally degraded at respective heat-treating temperatures ($T_A$) each lying above its Tx as may be imagined.

Figure 14:
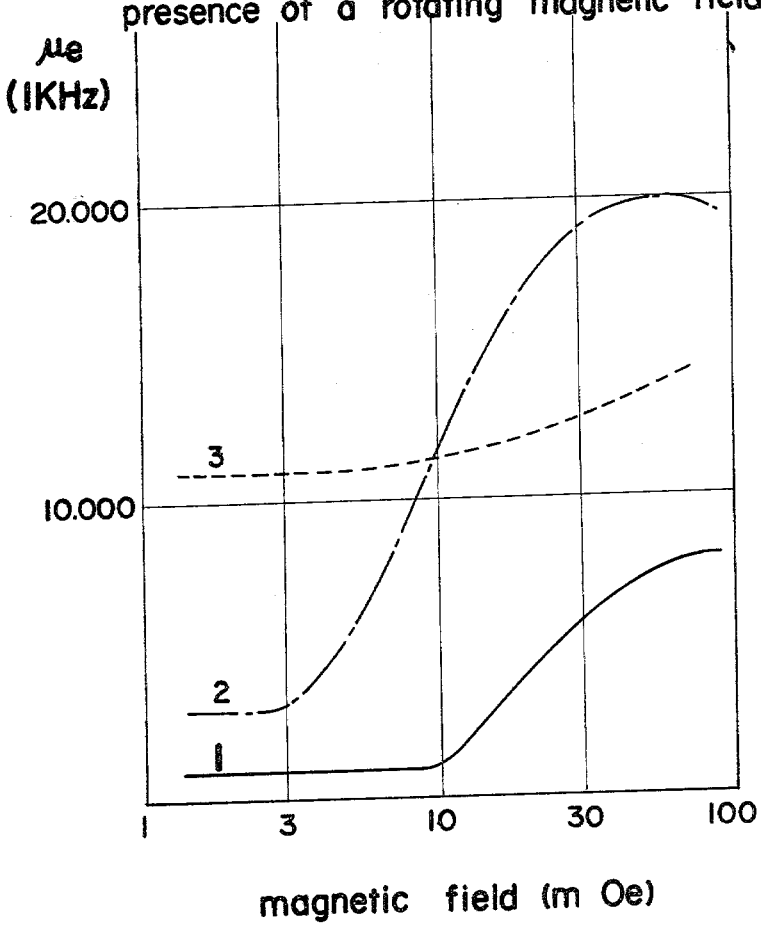
FIG. 14 is a plot of the effective permeability level characteristic of an amorphous alloy as a function of the measured magnetic field strength, in which a sample of amorphous alloy was heat-treated in the presence of a vertical magnetic field subsequent to the heat treatment in the presence of a rotating magnetic field.
Figure 15:
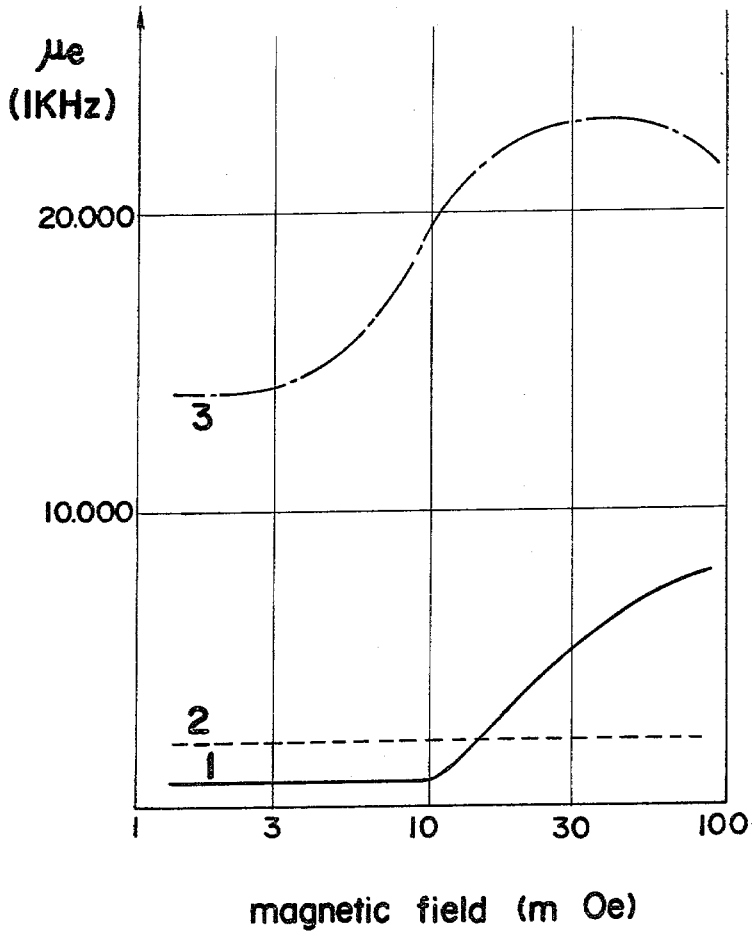
FIG. 15 is a plot of the effective permeability level characteristic of an amorphous alloy as a function of the measured magnetic field strength, in which a sample of amorphous alloy was heat-treated in the presence of a rotating magnetic field subsequent to the heat treatment in the presence of a vertical magnetic field.
Figure 16:
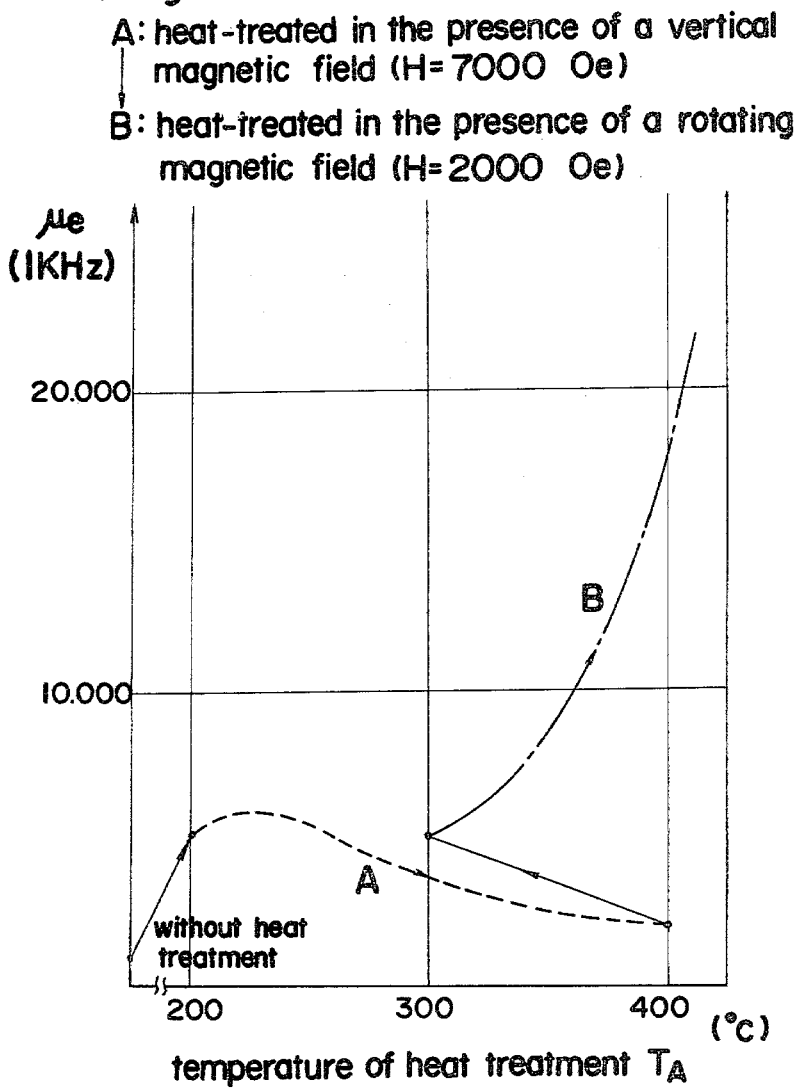
FIG. 16 is a plot of the effective permeability as a function of the heat-treating temperature, in which an associated heat-treating method (heat-treatment in the presence of a vertical magnetic field being associated with heat treatment in the presence of a rotating magnetic field was employed) and the measurement was made under a measured magnetic field strength of $10\times10^{-3}$Oe, as measured by the use of the Maxwell bridge at a frequency of 1 KHz.

The present inventors have already confirmed that when the aforesaid two magnetically heat-treating methods are associated, the consequently associated heat-treating method can serve for considerably enhancing the effective permeability of alternating current. The confirmation described above was experimentally obtained. Referring now to FIGS. 14 and 15, each shows a plot of the permeability level as a function of the measured magnetic field strength with the same sample material as employed in the experiment shown in FIG. 13 through the associated heat-treating method. As far as the strength of the magnetic field, the preferable strength lies in the range of 1000 to 15,000 Oe, irrespective of its direction. The most preferable strength is 7000 Oe for the vertical magnetic field, when the sample thickness is 40 μm, while the strength of 10,000 Oe is the most preferable for the rotating magnetic field. The measurement was made for respective permeabilities by the use of the Maxwell bridge at a frequency of 1 KHz. As is clear from FIGS. 14 and 15, the associated heat-treating method is quite effective, in which after having been heat-treated for a certain period at a certain temperature in the presence of a vertical magnetic field, the sample was heat-treated for a certain period at a certain temperature in the presence of the rotating magnetic field. Referring now to FIG. 16, there is shown a plot of the permeability as a function of the heat-treating temperature, in which the associated heat-treating method was executed.

TABLE 3

| Composition | Heat-treating method | (1 KHz) | μe retaining for 1000 hrs. at 70° C. (1 KHz) |
|---|---|---|---|
| $(Fe_8Co_{62}Ni_{30})_{75/100}Si_{15}B_{10}$ | after heat-treated for 30 min. at 400° C., air-cooled | 40000 | 38000 |
| Tc = 202° C. | after heat-treated for 30 min. at 400° C., water-cooled | 80000 | 52000 |
| Tx = 470° C. Bs = 5200 | heat-treated for 1 hr. at 200° C. in the vertical magnetic | | |
| (Tc << Tx) | field + heat-treated for 30 min. at 200° C. in the rotating magnetic field | 40000 | 38000 |
| $(Fe_{4.6}Co_{70.4})_{76.5/75}Si_{12}B_{11.5}$ | after heat-treated for 3 min. at 475° C., air-cooled | 6000 | 5500 |
| Tc = 460-° C. | after heat-treated for 3 min. at 475° C., water-cooled | 17000 | 5600 |
| Tx = 490° C. Bs = 9200 | heat-treated for 5 min. at 440° C. in the vertical | | |
| (Tc ≲ Tx) | magnetic field + heat-treated for 5 min. at 440° C. in the rotating magnetic field | 17000 | 14000 |
| $(Fe_{2.5}Mn_3Co_{71.5})_{80/75}Si_4B_{16}$ | after heat-treated for 3 min. at 410° C., air-cooled | 500 | 500 |
| Tc = 550° C. | after heat-treated for 3 min. at 410° C., water-cooled | 600 | 500 |
| Tx = 420° C. Bs = 11100 | after heat-treated for 30 min. at 220° C. in the vertical magnetic field | 5600 | 2100 |
| (Tc > Tx) | after heat-treated for 30 min. at 220° C. in the rotating mag- | 3300 | 1500 |

TABLE 3-continued

| Composition | Heat-treating method | (1 KHz) | μe retaining for 1000 hrs. at 70° C. (1 KHz) |
|---|---|---|---|
| | netic field heat-treated for 3 min. at 410° C. in the vertical magnetic field +0 heat-treated for 5 min. at 410° C. in the rotating magnetic field | 18000 | 15000 |

In Table 3, there are shown results of heat-treating three kinds of amorphous alloy materials, in which the comparison in magnetic properties is made between the results obtained by the use of the conventional heat-treating method and those obtained by the use of the present method. Furthermore, the accelerated test for each heat-treated sample was executed, so that the thermal stability of the permeability was examined. In the accelerated test, each sample, having been heat-treated, was retained for 1000 hours at 70° C. The result is also shown in Table 3. As is clear from the results shown in Table 3, with respect to the sample material satisfying the relation of $Tc << Tx$, as long as the sample material is heat-treated at a temperature $T_A$ satisfying the relation of $Tc << T_A < Tx$ and then, air-cooled, not only the permeability, but also its stability, are simultaneously enhanced. Hence, the conventional annealing method can bring about preferable results with respect to the magnetic properties. However, with respect to the sample material satisfying the relation of $Tc \leqq Tx$, when the material is heat-treated at a temperature $T_A$ satisfying the relation $Tc \leqq T_A < Tx$ and then, water-cooled, the magnetic properties of the material are improved to some extent. Namely, such being the case, although the permeability shown immediately after heat-treatment is enhanced, its stability per se is not so good. On the other hand, for such material, when the material is air-cooled, the stability of the permeability is quite high. However, the permeability immediately after heat-treatment is rather lower. As can be seen in the second column of Table 3, when such amorphous alloy material as described above is annealed, the present method is much superior to the other two, conventional, methods. Furthermore, with respect to the sample material satisfying the relation of $Tc > Tx$, the conventional methods can not work for the stated purpose at all, irrespective of the selection of the heat-treating temperature. According to the heat-treatment in the presence of either the vertical magnetic field or the rotating magnetic field, subject to the selection of the heat-treating temperature of approximately 200° C., the magnetic properties are improved to some extent. However, such improvement is quite litte, and the stability is also not so good, since the heat-treating temperature per se is rather too low. As far as such materials are concerned, the present heat-treating method can contribute to improve the magnetic properties and their consequent stabilities.

In conclusion, the heat-treating method in the presence of the magnetic field according to the present invention improves not only the magnetic properties of the amorphous alloy materials, but also their consequent stabilities. Especially, the present heat-treating method is quite effective for such amorphous alloy materials satisfying the relation of $Tc \geqq Tx$.

Although the present invention has been fully described by way of examples with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A method for heat-treating an amorphous alloy film, which comprises heating said amorphous alloy film at a temperature less than its Curie temperature and in the presence of a directed magnetic field, whose direction is perpendicular to the surface of said amorphous alloy film, so as to suppress induced magnetic anisotropy in said amorphous alloy film.

2. A method for heat-treating an amorphous alloy film, which comprises heating said amorphous alloy film in both of two manners so as to suppress induced magnetic anisotropy in said amorphous alloy film, one manner being heating said amorphous alloy film at a temperature less than its crystallization temperature in the presence of a directed magnetic field whose direction is substantially perpendicular to the surface of said amorphous alloy film, and the other manner being heating said amorphous alloy film at a temperature less than said crystallization temperature in the presence of a directed magnetic field whose direction is being changed within a parallel plane with respect to the plane of said amorphous alloy film.

3. A method as claimed in claim 1 or 2, wherein said amorphous alloy film is composed of Fe, Co, Si and B.

4. A method as claimed in claim 1 or 2, wherein the strength of said magnetic field is from 1,000 to 15,000 Oe.

* * * * *